US011659881B2

(12) United States Patent
Long

(10) Patent No.: US 11,659,881 B2
(45) **Date of Patent: *May 30, 2023**

(54) HELMET COVER ASSEMBLY HAVING AT LEAST ONE MOUNTING DEVICE

(71) Applicant: Gentex Corporation, Simpson, PA (US)

(72) Inventor: Richard J. Long, Lake Ariel, PA (US)

(73) Assignee: GENTEX CORPORATION, Simpson, PA (US)

( * ) Notice: Subject to any disclaimer, the term of this patent is extended or adjusted under 35 U.S.C. 154(b) by 437 days.

This patent is subject to a terminal disclaimer.

(21) Appl. No.: 16/830,952

(22) Filed: Mar. 26, 2020

(65) Prior Publication Data

US 2020/0260811 A1 Aug. 20, 2020

Related U.S. Application Data

(63) Continuation of application No. 14/238,493, filed as application No. PCT/US2013/046081 on Jun. 17, 2013, now Pat. No. 10,638,807.

(60) Provisional application No. 61/660,926, filed on Jun. 18, 2012.

(51) Int. Cl.

| | |
|---|---|
| ***A42B 3/06*** | (2006.01) |
| ***A42B 3/00*** | (2006.01) |
| ***A42B 3/04*** | (2006.01) |
| ***F41H 1/04*** | (2006.01) |

(52) U.S. Cl.

CPC ..... *A42B 3/003* (2013.01); *A42B 3/04* (2013.01); *A42B 3/0406* (2013.01); *F41H 1/04* (2013.01)

(58) Field of Classification Search

CPC ..... A42B 3/003; A42B 3/04; A42B 3/0406; F41H 1/04

See application file for complete search history.

(56) References Cited

U.S. PATENT DOCUMENTS

| | | | | |
|---|---|---|---|---|
| 2,969,547 | A | 12/1958 | Dye | |
| 3,245,087 | A | 4/1966 | Marchello | |
| 4,884,301 | A * | 12/1989 | Aileo | A42B 3/10 2/909 |
| 5,052,054 | A * | 10/1991 | Birum | A42B 1/08 2/10 |
| 5,265,276 | A | 11/1993 | Kimberly, Jr. | |
| 5,331,684 | A | 7/1994 | Baril et al. | |
| 5,467,479 | A | 11/1995 | Mattes | |
| 5,471,678 | A | 12/1995 | Dor | |
| 5,506,730 | A | 4/1996 | Morley et al. | |
| 5,608,919 | A | 3/1997 | Case | |
| 5,623,730 | A | 4/1997 | Baudou et al. | |

(Continued)

FOREIGN PATENT DOCUMENTS

| | | |
|---|---|---|
| CA | 2639453 A1 | 3/2009 |
| CA | 2669890 A1 | 12/2010 |

(Continued)

*Primary Examiner* — Richale L Quinn

(74) *Attorney, Agent, or Firm* — Morgan, Lewis & Bockius LLP

(57) ABSTRACT

A helmet cover includes a cover configured to extend over a helmet and at least one mount attached to the cover. In one embodiment, a backing plate is coupled to the at least one mount and the cover is sandwiched between the backing plate and the at least one mount.

18 Claims, 3 Drawing Sheets

(56) References Cited

U.S. PATENT DOCUMENTS 5,638,544 A * 6/1997 Sump ..... F41H 1/04 2/6.6
5,860,167 A 1/1999 Lizio
5,887,289 A 3/1999 Theoret
5,914,816 A 6/1999 Soto
6,009,561 A 1/2000 Bullock
6,009,562 A 1/2000 Bullock et al.
6,237,162 B1 5/2001 Gill
6,243,881 B1 6/2001 Brinkman
6,249,386 B1 6/2001 Yona et al.
6,256,799 B1 * 7/2001 McGlasson ..... A42B 3/003 2/422
6,457,179 B1 10/2002 Prendergast
6,472,776 B1 10/2002 Soto et al.
6,662,370 B1 12/2003 Buchanan
6,938,276 B1 9/2005 Prendergast
7,043,761 B2 5/2006 Epling
7,219,370 B1 5/2007 Teetzel
7,234,173 B2 6/2007 McCalla
7,418,738 B2 9/2008 Prendergast
7,444,683 B2 11/2008 Prendergast et al.
7,570,301 B2 8/2009 Gilor
7,752,683 B2 7/2010 Holloway
7,810,168 B2 10/2010 Reed et al.
7,849,517 B2 12/2010 Rogers et al.
7,895,672 B2 3/2011 Grey
7,898,503 B2 3/2011 Cuprys et al.
7,908,667 B2 3/2011 Rogers et al.
7,963,426 B2 6/2011 Gruebel et al.
7,996,917 B2 8/2011 Prendergast
8,015,626 B2 9/2011 Grassi
8,020,220 B2 9/2011 McElroy et al.
8,028,344 B2 10/2011 Rogers et al.
8,063,934 B2 11/2011 Donato et al.
8,087,100 B2 1/2012 Aguero et al.
8,120,857 B2 2/2012 Hedges
8,127,374 B2 3/2012 Willey
8,640,267 B1 2/2014 Cohen
9,149,085 B2 * 10/2015 Bryan ..... A42B 3/227
9,848,664 B2 12/2017 Poldoski
2002/0004946 A1 1/2002 Nelson
2004/0181856 A1 9/2004 Oleson
2005/0111097 A1 5/2005 Iannarelli et al.
2006/0282939 A1 12/2006 Rogers et al.
2007/0067894 A1 3/2007 Bourree et al.
2007/0107112 A1 * 5/2007 Boyd ..... A42B 3/003 2/46
2007/0114252 A1 5/2007 Gruebel et al.
2007/0214551 A1 9/2007 Teetzel et al.
2007/0245468 A1 * 10/2007 Butler ..... A42B 3/145 2/418
2008/0222782 A1 9/2008 Stokes
2008/0263752 A1 10/2008 Solinsky et al.
2009/0077721 A1 3/2009 Prendergast
2009/0083890 A1 * 4/2009 Dempsey ..... A42B 3/04 2/2.5
2010/0001927 A1 1/2010 Hough et al.
2010/0012692 A1 1/2010 Harris et al.
2010/0024097 A1 * 2/2010 Saenim ..... A42B 3/003 2/411
2010/0083413 A1 4/2010 McGovern
2010/0175172 A1 7/2010 Dempsey et al.
2010/0299814 A1 12/2010 Celona et al.
2010/0325784 A1 12/2010 Abbott et al.
2011/0072562 A1 3/2011 Prendergast
2011/0099695 A1 5/2011 Siviter
2011/0113535 A1 5/2011 Lebel et al.
2011/0145981 A1 6/2011 Teetzel et al.
2011/0239354 A1 10/2011 Celona et al.
2011/0252546 A1 10/2011 Junker et al.
2011/0252547 A1 * 10/2011 Leung ..... A42B 3/003 66/170
2011/0314594 A1 12/2011 Rogers et al.
2012/0002046 A1 1/2012 Rapoport et al.
2012/0011631 A1 1/2012 Crossman et al.
2013/0031692 A1 2/2013 Wratten
2013/0152281 A1 * 6/2013 Kravitz ..... A42B 3/205 2/421
2013/0276215 A1 * 10/2013 Eley, Sr. ..... A42B 3/0406 2/424
2015/0089726 A1 4/2015 Long
2015/0164169 A1 * 6/2015 Franco ..... A42B 3/0406 2/244
2016/0088891 A1 3/2016 Walsh et al.
2018/0360151 A1 * 12/2018 Desjardins ..... A42B 3/003
2019/0376646 A1 * 12/2019 Pombo ..... F16M 13/04

FOREIGN PATENT DOCUMENTS

CA 2753225 A1 3/2012
DE 202004001060 U1 5/2001
GB 548528 10/1942
GB 2365750 2/2002
GB 2474712 4/2011
GB 2477009 A 7/2011

* cited by examiner

HELMET COVER ASSEMBLY HAVING AT LEAST ONE MOUNTING DEVICE

CROSS-REFERENCE TO RELATED APPLICATIONS

This application is a Continuation of U.S. patent application Ser. No. 14/238,493 filed on Feb. 12, 2014, which is a U.S. National Stage filing of International Patent Application No. PCT/US13/46081 filed on Jun. 17, 2013 entitled "Helmet Cover Assembly Having At Least One Mounting Device", which claims the benefit of U.S. Provisional Patent Application No. 61/660,926 filed Jun. 18, 2012 entitled "Helmet Cover Assembly Having At Least One Mounting Device", each of which is incorporated by reference herein in its entirety.

BACKGROUND OF THE INVENTION

The present invention generally relates to a helmet cover assembly having at least one mounting device.

BRIEF SUMMARY OF THE INVENTION

In one embodiment there is a helmet cover assembly comprising a cover configured to extend over a helmet and at least one mounting device attached to the cover. In a further embodiment, the helmet cover includes a backing plate coupled to the at least one mounting device. In one embodiment, the cover is sandwiched between the backing plate and the at least one mounting device. In one embodiment, the backing plate is coupled to two or more of the at least one mounting device. In one embodiment, an outer periphery of the backing plate extends past an outer periphery of at least one of the at least one mounting device. In one embodiment, the backing plate has a contour that matches a corresponding contour of the helmet. In one embodiment, the cover couples the backing plate and at least one mounting device to the helmet. In one embodiment, the backing plate extends at least half way around a periphery of the helmet.

In one embodiment, the cover is coupled to the helmet by one or more fasteners. In one embodiment, the one or more fasteners includes one or more hook and pile fasteners configured to attach to an inside surface of the helmet. In one embodiment, the at least one mount includes a night vision goggle mount. In one embodiment, the at least one mount includes at least one side rail mount. In one embodiment, the at least one mount includes a night vision goggle mount and two side rail mounts. In one embodiment, the cover extends over an entire outer surface of the helmet. In one embodiment, the cover extends over a bottom edge of the helmet and is releasably coupled to an inside surface of the helmet. In one embodiment, the cover is attachable to the helmet using only hook and pile fasteners. In one embodiment, the cover is comprised of a non-elastic material.

BRIEF DESCRIPTION OF THE SEVERAL VIEWS OF THE DRAWINGS

The following detailed description of embodiments of the helmet cover assembly, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
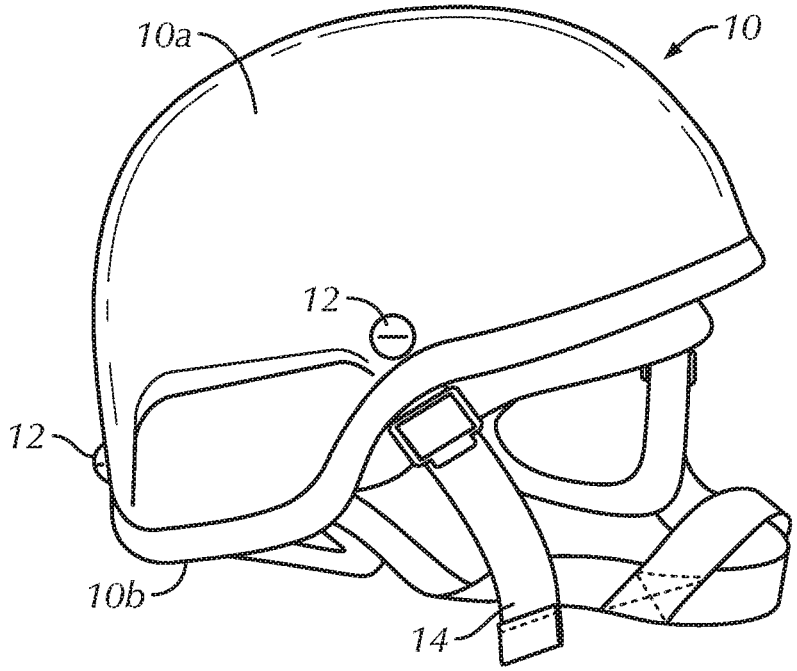
FIG. 1 (Prior Art)
FIG. 1 is a side perspective view of a prior art helmet.

Referring to the drawings in detail, wherein like reference numerals indicate like elements throughout, there is shown in FIGS. 2-8 a helmet cover assembly, generally designated 16, in accordance with an exemplary embodiment of the present invention.

Helmets for head protection are worn in a variety of environments and for various purposes including adventure, sporting, police and military purposes. An exemplary ballistic helmet used in the military is shown in FIG. 1. Accessories may be added or attached to the helmet according to the needs of the wearer and the demands of the environment in which the helmet is to be used. Accessories may include night vision goggles, lights, strobe lights, face shields, neck protection, headsets, video cameras, sunglasses, goggles, oxygen masks and other devices. The method of attaching accessories may include attaching a mount to the helmet shell. The accessory may be releasably coupled to the mount so the accessory can be removed from the helmet when not in use. Mounts are typically attached to helmet shell 10 by using screws or snaps requiring holes to be drilled in the shell or straps that are clamped or clipped to an edge 10*b* of helmet shell 10.

Figure 2:
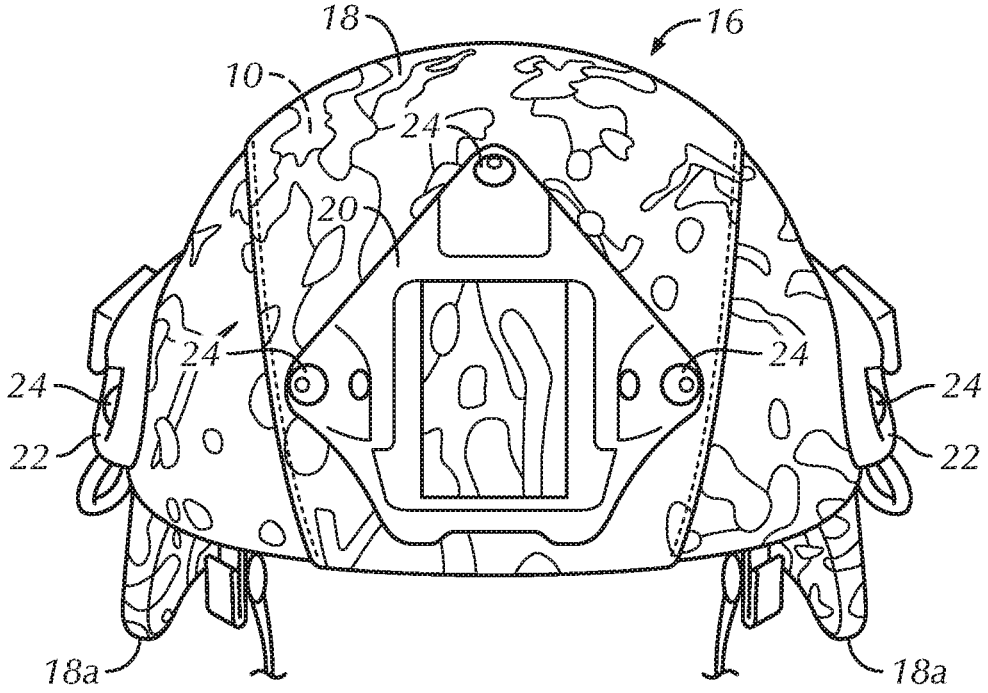
FIG. 2 is a front view of a helmet cover assembly in accordance with an exemplary embodiment of the present invention shown on a helmet.
Figure 3:
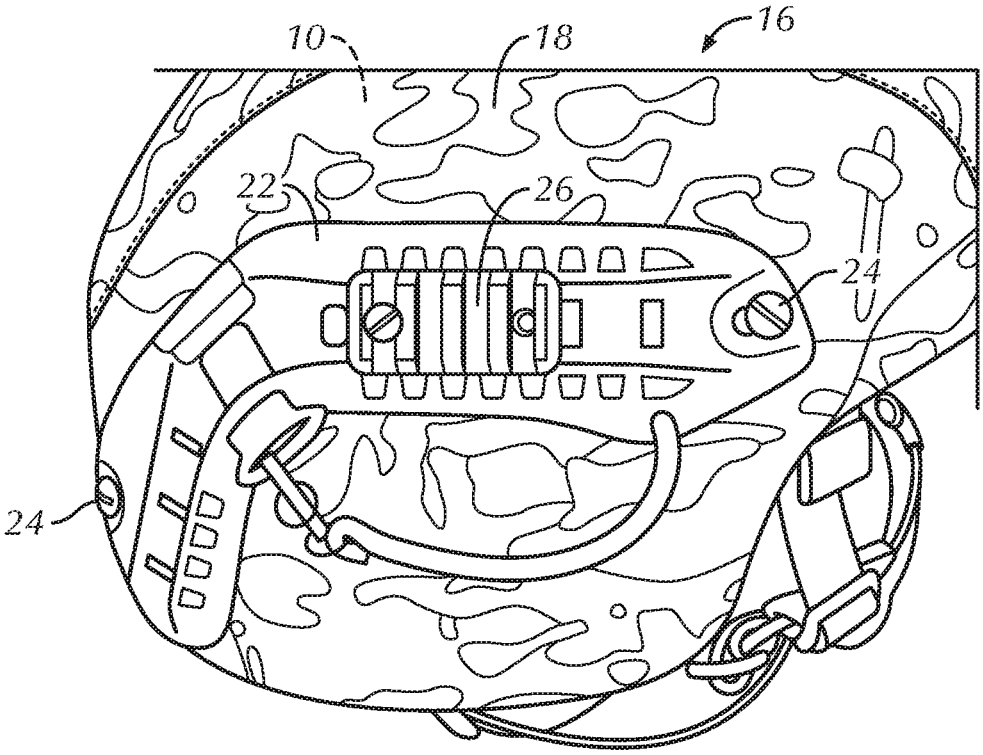
FIG. 3 is a side view of the helmet cover shown in FIG. 2.
Figure 4:
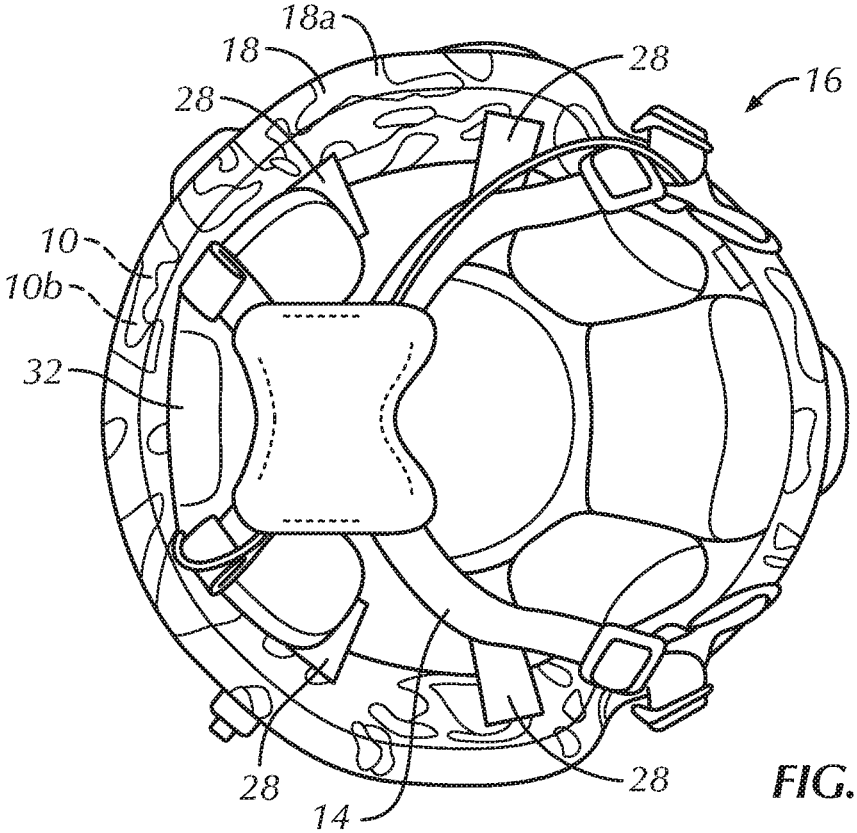
FIG. 4 is a bottom view of the helmet cover shown in FIG. 2.
Figure 5:
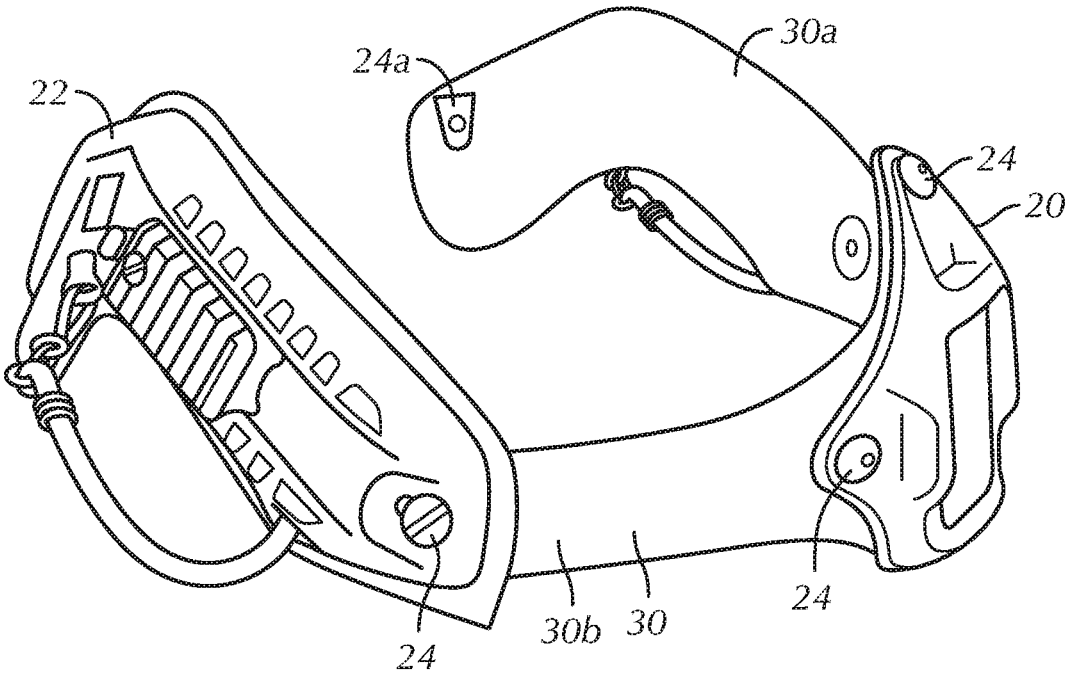
FIG. 5 is a perspective view of the helmet cover shown in FIG. 2 removed from the helmet and without the cover.
Figure 6:
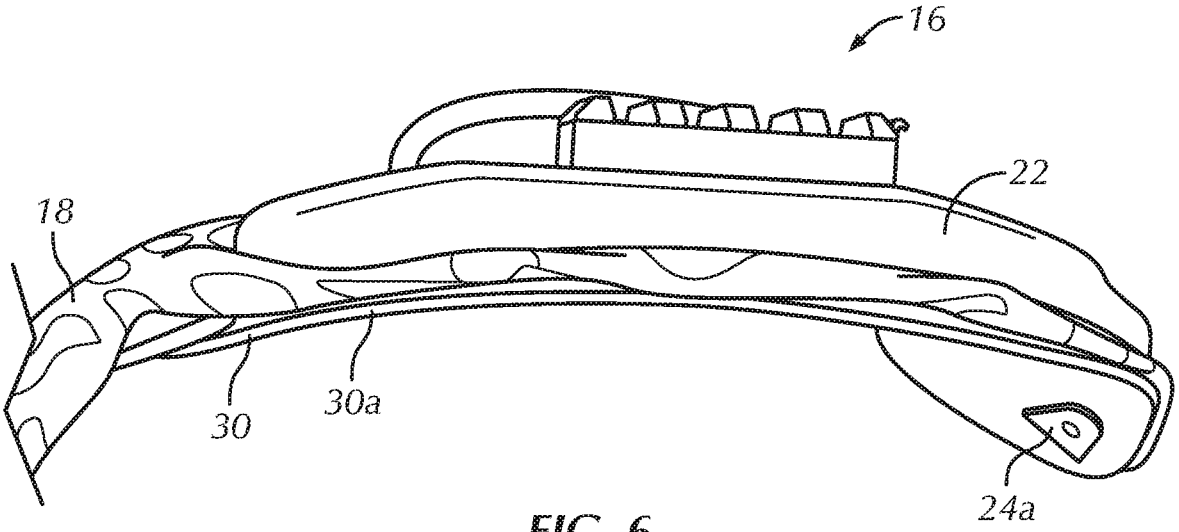
FIG. 6 is a partial bottom view of the helmet cover shown in FIG. 2 removed from the helmet.

Referring to FIGS. 2 and 3, in one embodiment, helmet cover assembly 16 includes one or more mounting devices 20, 22 that are secured to a cover 18 for attachment of accessory components 26. Referring to FIGS. 5 and 6, in some embodiments, one or more mounting devices 20, 22 are attached to cover 18 through the use of fasteners 24 and one or more backing plates 30 with cover 18 sandwiched in between mounting devices 20, 22 and backing plates 30. Referring to FIGS. 2 and 4, in some embodiments, cover 18 extends over an exterior 10*a* (see FIG. 1) of a helmet shell 10 and attaches via one or more cover fasteners 28 on the inside surface of helmet shell 10. Cover 18 may be sized and shaped to be snug or otherwise secured to exterior 10*a* of helmet shell 10 to minimize the movement of mounting devices 20, 22 relative to helmet shell 10 during use.

In some embodiments, attaching mounting devices 20, 22 to helmet cover assembly 16 rather than directly to helmet shell 10 eliminates or at least reduces the need to drill mounting holes in helmet shell 10 that may affect the performance properties of helmet shell 10. In some embodiments, attaching mounting devices 20, 22 to helmet cover assembly 16 rather than directly to helmet shell 10 allows a user to more quickly mount and remove mounting devices 20, 22 to and from helmet shell 10. In some embodiments, attaching mounting devices 20, 22 to helmet cover assembly 16 rather than directly to helmet shell 10 allows a user to more quickly exchange a mounting configuration for a different mounting configuration. In some embodiments, attaching mounting devices 20, 22 to helmet cover assembly 16 rather than directly to helmet shell 10 allows a user to quickly install all of the necessary mounting device 20, 22 at once rather than attach each mounting device 20, 22 individually. In some embodiments, attaching mounting devices 20, 22 to helmet cover assembly 16 rather than directly to helmet shell 10 allows a user to attach one or more mounting devices to helmet shell 10 without the use of tools. In some embodiments, attaching mounting devices 20, 22 to helmet cover assembly 16 rather than directly to helmet shell 10 allows a user to incorporate the appropriate camouflage pattern or color to helmet shell 10.

Referring to FIGS. 2 and 3, in one embodiment, the material used for cover 18 is configured to provide a stable base for attaching mounting devices 20, 22 to helmet shell 10. Cover 18 may extend over the entire exterior surface 10*a* of helmet shell 10. In one embodiment, cover 18 extends substantially over the entire exterior surface 10*a* of helmet shell 10. In other embodiments, cover 18 includes one or more openings to expose one or more portions of exterior surface 10*a* of helmet shell 10. Cover 18 may be resistant to tearing, ripping and stretching. In one embodiment, cover 18 is non-elastic. In one embodiment, cover 18 is flexible. In one embodiment, cover 18 is comprised of a textile. In one embodiment, cover 18 is comprised of a fabric. In one embodiment, cover 18 is comprised of canvas. In one embodiment, cover 18 is comprised of ripstop. In one embodiment, cover 18 is comprised of twill. Cover 18 may include a pattern or image. In one embodiment, cover 18 is camouflage patterned.

Referring to FIGS. 5 and 6, in some embodiments, one or more backing plates 30 are used to attach the mounting devices 20, 22 to cover 18. Cover 18 may be sandwiched between backing plate 30 and mounting devices 20, 22. In one such embodiment, outer surface 30*b* of backing plate 30 contacts mounting devices 20, 22 and inner surface 30*a* of backing plate 30 contacts exterior surface 10*a* of helmet shell 10. Alternatively, backing plate 30 may be positioned in between layers of cover 18 such that the entire thickness of cover 18 is only partially sandwiched between backing plate 30 and mounting devices 20, 22. In one such embodiment, only cover 18 contacts exterior surface 10*a* of helmet shell 10. Backing plate 30 may be provided to help secure mounting devices 20, 22 to cover 18. Backing plate 30 may be provided to stabilize mounting devices 20, 22 relative to helmet shell 10. In one embodiment, backing plate 30 is stiffer than cover 18. In one embodiment, backing plate 30 is flexible enough to generally conform to the shape of helmet shell 10 while strong enough to prevent mounting devices 20, 22 from detaching from cover 18. In some embodiments, backing plate 30 is substantially rigid. In some embodiments, backing plate 30 is pre-shaped to match the contour of helmet shell 10.

In one embodiment, backing plate 30 is comprised of a thermoset plastic. In one embodiment, backing plate 30 is comprised of acrylonitrile butadiene styrene. In one embodiment, backing plate 30 is comprised of polyethylene. In one embodiment, backing plate 30 is comprised of KYDEX®, or acrylic-polyvinyl chloride materials. In one embodiment, backing plate 30 is comprised of 0.030 inch thick, grade 1, class M polyethylene. In one embodiment, backing plate 30 is comprised of 0.040 inch thick, grade 1, class L polyethylene. In one embodiment, backing plate 30 is comprised of 0.032 inch thick virgin acrylonitrile butadiene styrene, spectrum #250, type B210 B33420 such as ROYALITE®. In some embodiments, backing plate 30 is comprised of metal. In some embodiments, backing plate 30 is comprised of aluminum. In one embodiment, backing plate 30 is approximately 0.060 inches thick.

Backing plate 30 may be a single component that is secured to two or more mounting devices 20, 22. The footprint of backing plate 30 may be larger than the footprint of mounting devices 20, 22. In one embodiment, backing plate 30 extends more than half way around the periphery of helmet shell 10. In one embodiment, backing plate 30 extends around the entire periphery of helmet shell 10. In one embodiment, backing plate 30 extends approximately three quarters of the way around the periphery of helmet shell 10. In one embodiment, backing plate 30 generally matches the outer perimeter of mounting devices 20, 22. In one embodiment, backing plate 30 generally matches the outer contour of mounting devices 20, 22 and extends between mounting devices 20, 22 in order to connect mounting devices 20, 22 to one another. In one embodiment, mounting devices 20, 22 are attached to backing plate 30 and then the backing plate 30 is trimmed to generally match the outer contour of mounting devices 20, 22. Attaching mounting devices 20, 22 relative to one another through backing plate 30 may help to minimize movement of cover 18 and make the backing plate 30 stronger.

In other embodiments, each mounting device 20, 22 has a separate backing plate 30. In some embodiments, separate backing plates 30 are attached to one another to form a single base. In one embodiment, adjacent backing plates 30 are coupled to one another at an adjustable length. Providing an adjustable length between backing plates 30 may allow for use with different sized helmet shells 10. In one embodiment, adjacent backing plates 30 are coupled to one another using overlapping hook and pile portions. In one embodiment, adjacent backing plates 30 are coupled to one another using a strap having one or more adjustment slides.

Referring to FIGS. 2, 5 and 6, in one embodiment, mounting devices 20, 22 are attached to backing plate 30 using one or more fasteners 24. In one embodiment, backing plate 30 includes one or more holes for accepting fasteners 24. In one embodiment, at least a portion of cover 18 is positioned between backing plate 18 and mounting device 20, 22 and one or more fasteners is added to secure the assembly together. In one embodiment, fasteners 24 include a nut or plate 24*a* configured to secure fastener 24 to backing plate 30. In one embodiment, plate 24*a* is generally flush with backing plate 30. In one embodiment, plate 24*a* is at least twice as wide as the diameter of hole through which fastener 24 extends through. Plate 24*a* may be configured to prevent fastener 24 from being pulled through backing plate 30. In one embodiment, fasteners 24 are rivets. In one embodiment, fasteners 24 include a screw. In one embodiment, fasteners 24 are grommets. In one embodiment, fasteners 24 include a fastener used to secure a mounting device 20, 22 directly to helmet shell 10. In one embodiment, fasteners 24 include a projection from backing plate 30 or mounting device 20, 22 that is heat welded to fasten backing plate 30 and mounting device 20, 22 together.

Referring to FIG. 2, in some embodiments, cover 18 may include one or more prefabricated slots or holes for receiving fasteners 24. Such openings may have a sewn edge or are seared to prevent fraying of cover 18 around the periphery of the opening. In other embodiments, no pre-existing holes are provided in cover 18 and fasteners 24 are forced through cover 18. In some embodiments, backing plate 30 is secured to cover 18. In one embodiment, backing plate 30 is sewn to cover 18. In one embodiment, backing plate 30 is glued to cover 18. In one embodiment, fasteners in addition to fasteners 24 are used to secure backing plate 30 to cover 18. Cover 18 may include one or more pockets for retraining at least a portion of backing plate 30.

Referring to FIG. 4, in one embodiment, cover 18 attaches helmet cover assembly 16 to helmet shell 10. In one embodiment, only cover 18 couples mounting devices 20, 22 to helmet shell 10. In one embodiment, cover 18 wraps around bottom edge 10*b* of helmet shell 10. In one embodiment, cover 18 wraps around the entire bottom edge 10*b* of helmet shell 10. In one embodiment, helmet cover assembly 16 includes one or more cover fasteners 28 to secure cover 18 to helmet shell 10. In one embodiment, cover 18 and cover fasteners 28 are configured to substantially prevent movement of cover 18 relative to helmet shell 10. In one embodiment, cover 18 is pulled into a snug relationship with helmet shell 10 before attaching cover 18 to helmet shell 10 with cover fasteners 28. In one embodiment, cover 18 is shaped such that once cover 18 is in place on helmet shell 10, cover 18 snuggly fits onto helmet shell 10.

In one embodiment, cover fasteners 28 include one or more hook and pile strips attached proximate to edge 18*a* of cover 18. In one embodiment, cover 18 includes a plurality of cover fasteners 28 spaced around edge 18*a*. In one embodiment, cover fasteners 28 include corresponding fasteners mounted to the inside surface of helmet shell 10 proximate a bottom edge 10*b*. The corresponding fasteners mounted to the inside surface of helmet shell 10 may include preexisting fasteners such as those used to retain padding 32. In other embodiments, additional corresponding fasteners are provided. In other embodiments, cover 18 may include a strap or elastic band to retain cover 18 to helmet shell 10. In one embodiment, cover 18 includes one or more clips to secure cover 18 to edge 10*b* of the helmet shell 10.

In one embodiment, cover 18 retains helmet cover assembly 16 to helmet shell 10 without any fasteners extending into helmet shell 10. In one embodiment, cover assembly 16 is mountable onto helmet shell 10 without the use of tools. In one embodiment, cover 18 retains helmet cover assembly 16 to helmet shell 10 without having to modify the original helmet. In one embodiment, cover 18 retains helmet cover assembly 16 to helmet shell 10 without having to drill additional holes into helmet shell 10. In one embodiments, one or more pre-existing fasteners 12 (See FIG. 1) or a fastener configured to use the pre-existing helmet holes, may be configured to extend through backing plate 30 to further secure helmet cover assembly 16 to helmet shell 10. For example, pre-existing fasteners 12 used to secure chinstrap 14 to helmet shell 10 may be replaced with longer fasteners configured to extend through mounting device 22, cover 18, and backing plate 30 to further secure helmet cover assembly 16 to helmet shell 10.

Helmet cover assembly 16 may be configured such that it can substantially support the weight of and forces exerted on the accessories as if mounting devices 20, 22 were attached directly to helmet shell 10.

Referring to FIGS. 2 and 3, in some embodiments, mounting devices 20, 22 may include but are not limited to one or more mounting devices such as rails (e.g., an ARC or Picatinny rail) and/or night vision goggle ("NVG") mounts (e.g. a shroud mount). FIG. 2 shows an exemplary embodiment having one NVG mount (e.g., mounting device 20), secured by shroud mount fasteners, (e.g. fasteners 24 attached to mounting device 20), and two side ARC rails. In one embodiment, one or more additional helmet cover assemblies 16 may be provided in order to attach different mounting mechanisms 20, 22 and/or a different color or patterned cover 18 and/or mounting devices 20, 22. Since mounting devices 20, 22 are typically attached directly to helmet shell 10 or other platform surface, they may be contoured to match exterior surface 10*a* of helmet shell 10. In some embodiments, matching the contour of helmet shell 10 is not necessary as backing plate 30 can be configured to match exterior surface 10*a* of helmet shell 10 while attaching to whatever contour the mounting device may have.

In one embodiment, cover 18 is configured to make mounting devices 20, 22 more flush with the helmet as compared to attaching the same mounting devices 20, 22 directly to helmet shell 10. In one embodiment, cover 18 is configured to cover or reduce the distance that an edge or projection on mounting devices 20, 22 extend from helmet shell 10 and could catch on something such as a parachute shroud line when mounting device 20, 22 is not attached with an accessory.

In addition to mounting devices 20, 22, in some embodiments, cover 18 also includes pile tape, goggle retaining straps, IR patches, battery pouch or other items to support user requirements.

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

I claim:

1. A helmet cover assembly for covering a helmet, the helmet having an exterior surface, an inside surface that is opposite the exterior surface, and a bottom edge, the helmet cover assembly comprising:

a cover comprised of a flexible material and configured to extend over the exterior surface of the helmet, the cover including a left side portion, a right side portion, and a front portion extending between the left side portion and the right side portion;

a shroud mount having a recessed rectangular mounting area configured to receive a night vision goggle (NVG) mount arm, the shroud positioned proximate the front portion of the cover and having an interior curve configured to correspond to a front curve of the exterior surface of the helmet;

a first side rail mount having a first elongated groove configured to receive an attachment in one of a plurality of positions along the length of the first elongated groove, the first side rail mount coupled to the left side portion of the cover, the first side rail mount having an interior curve configured to correspond to a first side curve of the exterior surface of the helmet;

a second side rail mount having a second elongated groove configured to receive an attachment in one of a plurality of positions along the length of the second elongated groove, the second side rail mount coupled to the right side portion of the cover, the second side rail mount having an interior curve configured to correspond to a second side curve of the exterior surface of the helmet;

a first component extending from the first side rail mount to the shroud mount and coupled to the first side rail mount and the shroud mount; and a second component extending from the shroud mount to the second side rail mount and coupled to the shroud mount and the second side rail mount, wherein the helmet cover assembly is configured to be secured to the helmet without any fasteners extending from either of the first or second side rail mounts through the exterior surface of the helmet.

2. The helmet cover assembly of claim 1, wherein the first component comprises a first backing plate coupled to at least one of the first side rail mount and the shroud mount, and wherein the second component comprises a second backing plate coupled to at least one of the second side rail mount and the shroud mount.

3. The helmet cover assembly of claim 2, wherein the left side portion of the cover is sandwiched between the first backing plate and the first side rail mount, and the right side portion of the cover is sandwiched between the second backing plate and the second side rail mount.

4. The helmet cover assembly of claim 2, wherein the first side rail mount and the shroud mount are each coupled to the first backing plate and the second side rail mount and the shroud mount are each coupled to the second backing plate.

5. The helmet cover assembly of claim 2, wherein an outer periphery of the first and second backing plates, respectively, extend past an outer periphery of at least one of the first side rail mount, second side rail mount, and shroud mount.

6. The helmet cover assembly of claim 2, wherein the first and second backing plates are configured to correspond to a contour of the exterior surface of the helmet.

7. The helmet cover assembly of claim 2, wherein the cover is configured to couple the first and second backing plates and the first side rail mount, second side rail mount and shroud mount to the helmet.

8. The helmet cover assembly of claim 2, wherein the first and second backing plates combined are configured to extend at least halfway around a periphery of the helmet.

9. The helmet cover assembly of claim 1, wherein the cover comprises a plurality of hook and loop fasteners extending outwardly from a peripheral edge of the cover, the plurality of hook and loop fasteners configured to couple to the inside surface of the helmet.

10. The helmet cover assembly of claim 1 further comprising:

at least one shroud mount fastener extending through the shroud mount and configured to extend through the exterior surface of the helmet and attach the shroud mount to the helmet.

11. The helmet cover assembly of claim 1, wherein the cover is configured to extend over the entire exterior surface of the helmet.

12. The helmet cover assembly of claim 1, wherein the flexible material is comprised of a non-elastic material.

13. The helmet cover assembly of claim 1, wherein the flexible material is comprised of a fabric.

14. The helmet cover assembly of claim 1, wherein the flexible material is comprised of canvas.

15. The helmet cover assembly of claim 1, wherein one or more holes are prefabricated in the cover.

16. The helmet cover assembly of claim 1, wherein the first component and the second component are flexible to conform to a shape of the helmet.

17. A helmet assembly comprising:

a helmet having a bottom edge, an exterior surface, and an interior surface;

a cover comprised of a flexible material extending over the exterior surface of the helmet, extending over the bottom edge of the helmet, and releasably coupled to an inside surface of the helmet by a plurality of hook and pile fasteners extending from a peripheral edge of the cover, the cover including a left side portion, a right side portion, and a front portion extending between the left side portion and the right side portion;

a shroud mount having a recessed rectangular mounting area configured to receive a night vision goggle (NVG) mount arm and having an interior curve corresponding to a front curve of the exterior surface of the helmet;

a first side rail mount having a first elongated groove configured to receive an attachment in one of a plurality of positions along the length of the first elongated groove, the first side rail mount coupled to the left side portion of the cover, the first side rail mount having an interior curve corresponding to a first side curve of the exterior surface of the helmet;

a second side rail mount having a second elongated groove configured to receive an attachment in one of a plurality of positions along the length of the second elongated groove, the second side rail mount coupled to the right side portion of the cover, the second side rail mount having an interior curve corresponding to a second side curve of the exterior surface of the helmet; and a component connecting the shroud mount, first side rail mount, and second side rail mount, the component exterior to the exterior surface of the helmet and having a shape corresponding to the exterior surface of the helmet, the shroud mount, first side rail mount, and second side rail mount being coupled to the component by one or more fasteners which extend through the shroud mount, first side rail mount, second side rail mount, through the one or more holes, wherein the shroud mount is coupled to the exterior surface of helmet by a fastener extending through the exterior surface of the helmet.

18. The helmet assembly of claim 17, wherein the component is flexible to conform to a shape of the helmet.

* * * * *